US007051732B2

(12) United States Patent
Uusitalo et al.

(10) Patent No.: US 7,051,732 B2
(45) Date of Patent: May 30, 2006

(54) RESPIRATOR MASK

(75) Inventors: Jussi Severi Uusitalo, Vaasa (FI); Jyrki Hannu Veli Jarvinen, Vaasa (FI); Juha Antero Kinnunen, Helsinki (FI); Ville-Petteri Nenonen, Vantaa (FI)

(73) Assignee: Scott Technologies, Inc., Beachwood, OH (US)

( * ) Notice: Subject to any disclaimer, the term of this patent is extended or adjusted under 35 U.S.C. 154(b) by 0 days.

(21) Appl. No.: 10/450,490

(22) PCT Filed: Apr. 23, 2002

(86) PCT No.: PCT/US02/12597

§ 371 (c)(1),
(2), (4) Date: Jan. 9, 2004

(87) PCT Pub. No.: WO03/000109

PCT Pub. Date: Jan. 3, 2003

(65) Prior Publication Data

US 2004/0182385 A1 Sep. 23, 2004

Related U.S. Application Data

(60) Provisional application No. 60/285,876, filed on Apr. 23, 2001.

(51) Int. Cl.
*A62B 7/10* (2006.01)

(52) U.S. Cl. ..... 128/201.25; 128/201.24

(58) Field of Classification Search ..... 128/201.22, 128/201.23, 201.24, 201.25, 201.29; 2/424, 2/6.3, 6.4, 6.5
See application file for complete search history.

(56) References Cited

U.S. PATENT DOCUMENTS

| | | | | | |
|---|---|---|---|---|---|
| 3,543,308 | A | * | 12/1970 | Stapenhill | 2/6.4 |
| 3,568,211 | A | * | 3/1971 | Petruzella, Jr. | 2/410 |
| 3,833,935 | A | * | 9/1974 | Ansite et al. | 2/6.2 |
| 4,502,480 | A | * | 3/1985 | Yamamoto | 128/201.15 |
| 5,097,826 | A | * | 3/1992 | Gray et al. | 128/204.18 |
| 5,758,639 | A | * | 6/1998 | Ikonen | 128/201.25 |

* cited by examiner

*Primary Examiner*—Aaron J. Lewis
(74) *Attorney, Agent, or Firm*—Armstrong Teasdale LLP; Dean D. Small

(57) ABSTRACT

The present invention is directed to a respiratory helmet. The helmet is designed to provide protection to a user's cranium area. The helmet also has a visor designed to provide protection to the user's face area, an air intake system, and a parallel elliptical rail system. The visor can be positioned on the helmet, in front of the user's face area, and any position in between. The area between the visor, when the visor is positioned in front of the user's face area and the face area is called the breathing zone. The visor has at least two wheels, a top side and a bottom side wherein the bottom side is positioned closer to the user's chin when the visor is positioned in front of the user's face. The air intake system has an intake unit that receives a gaseous medium from a gaseous medium supply system or the ambient air into the helmet, and the intake unit directs the gaseous medium toward the breathing zone. The parallel elliptical rail system allows the visor to move in an elliptical motion. Each rail receives at least one wheel of the visor, and is designed to decrease the accumulation of particulates on the rail.

44 Claims, 8 Drawing Sheets

RESPIRATOR MASK

CLAIM OF PRIORITY

This application claims priority to U.S. provisional application Ser. No. 60/285,876 that was filed on Apr. 23, 2001.

FIELD OF THE INVENTION

The present invention is directed to a respirator helmet with a movable visor.

BACKGROUND OF THE INVENTION

There are numerous types of respirator helmets. Many respirator helmets have an interior space between the head and the interior surface of the respirator helmet. Within that space, the respirator helmet is designed to forward a sufficient amount of air toward the nose and mouth of the user of the respirator helmet. The air is forwarded toward the user's breathing orifices by either a built-in air filter and fan, or by a remote air supply system that feeds the air into the helmet interior through a suitable tube or pipe. Containing the air about the user's orifices is accomplished through a suitable design of a full-face visor, normally transparent. Examples of these respiratory helmets are disclosed in U.S. Pat. Nos. 4,590,951, 4,097,929 and 4,136,688, all of which are commonly assigned to Racal Limited or subsidiaries thereof.

The invention disclosed in the '929 patent is a protective visor. The visor "comprises an arcuately curved frame having an aperture arranged to accept an arcuately flexed rectangular sheet of resilient transparent material. The sheet is retained in the frame by lugs extending into the aperture at staggered positions on the inner and outer margins of the upper and lower frame bars and has at the sides of the aperture recesses in the frame side bars into which the lateral edges of the transparent sheet will snap. The sheet may be of transparent polycarbonate [material] and the frame of either transparent or opaque polycarbonate. Preferably the frame has at its upper corners hinge members for attachment to a protective helmet."

The helmet disclosed in the '929 patent, however, was apparently not sufficiently dust proof because Racal filed another application that matured into the '688 patent that addressed that problem. In particular, Racal suggested using bristles within the helmet to solve this problem.

In each helmet illustrated in the '929 and '688 patents, there is a hard helmet having an exterior and interior surface, a visor that rotates about a single point immediately above the user's ears, an air space between a user's head and the interior surface, and an aperture on the rear of the helmet to receive an air tube. This air space is where the air from the air tube traverses through the helmet. The air is pushed through this air space by a fan, which is positioned near the aperture, within the interior surface, and spaced away from the user's head by a second interior wall. The air enters the interior of the helmet, and is pushed into the area between the visor and the user's mouth.

After a number of years, Racal filed another application that matured into the '951 patent. The '951 patent illustrates a different embodiment of a respiratory helmet. Instead of the air hose entering the helmet at or near the anterior neck, the air tube enters the helmet near the user's mouth. As such, Racal was working on alternative embodiments of a respirator helmet to correct the problems of the previous models, some which are mobility of the head and dirt permeating through the shield due to a poor pivot point.

SUMMARY OF THE INVENTION

The present invention is directed to a respiratory helmet. The helmet is designed to provide protection to a user's cranium area. The helmet also has a visor designed to provide protection to the user's face area, an air intake system, and a parallel elliptical rail system. The visor can be positioned on the helmet, in front of the user's face area, and any position in between. The area between the visor, when the visor is positioned in front of the user's face area and the face area is called the breathing zone. The visor has at least two wheels, a top side and a bottom side wherein the bottom side is positioned closer to the user's chin when the visor is positioned in front of the user's face. The air intake system has an intake unit that receives a gaseous medium from a gaseous medium supply system or the ambient air into the helmet, and the intake unit directs the gaseous medium toward the breathing zone. The parallel elliptical rail system allows the visor to move in an elliptical motion. Each rail receives at least one wheel of the visor, and is designed to decrease the accumulation of particulates on the rail.

BRIEF DESCRIPTION OF THE FIGURES

FIGS. 7*a–f* illustrate alternative embodiments of the present invention.

DETAILED DESCRIPTION OF THE INVENTION

Figure 1:
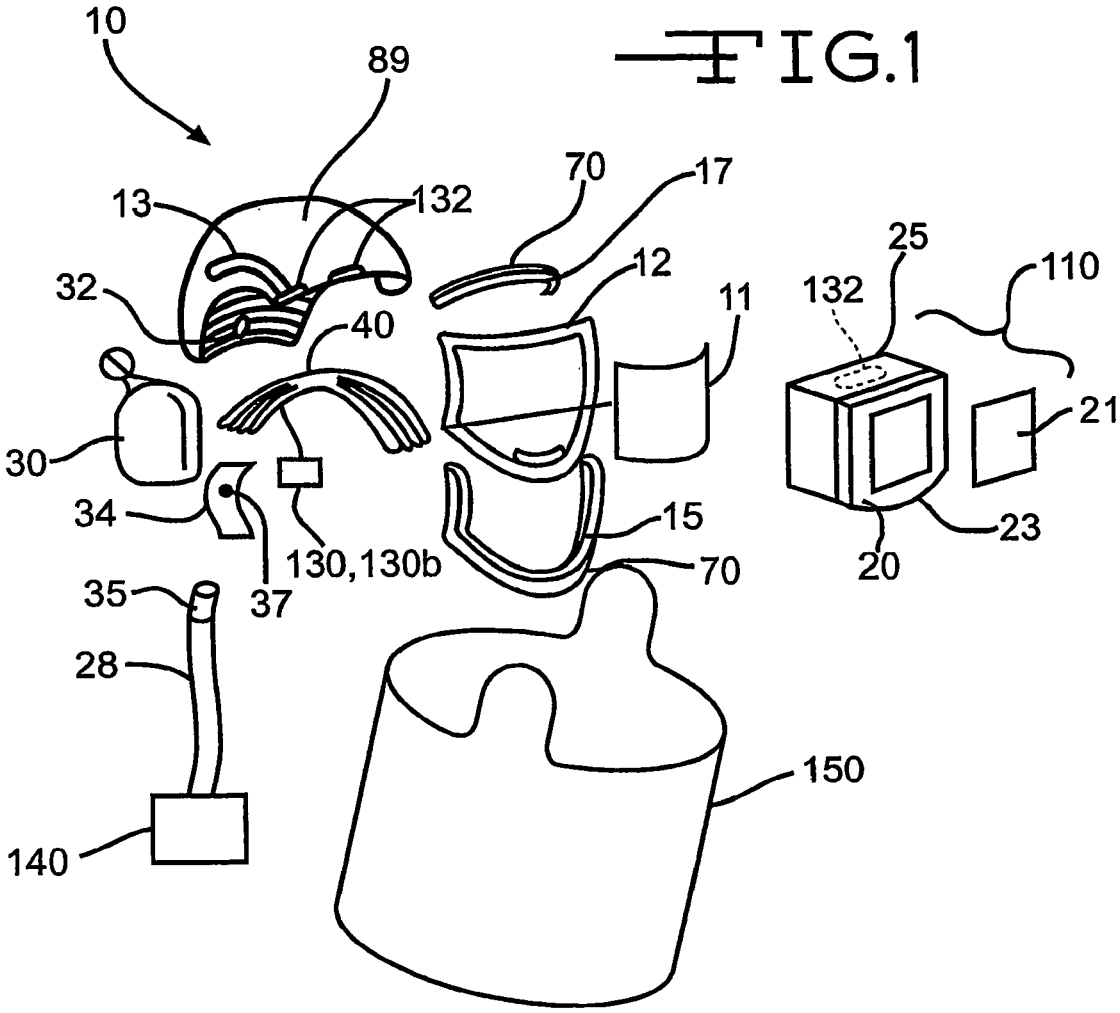
FIG. 1 is an exploded view of the present invention.

FIG. 1 shows an exploded view of respirator helmet 10 including a first visor assembly 11, a second visor assembly 110. The first visor assembly 11 includes a frame member 12 which is attached by way of wheels, preferably made of elastomeric plastic material and will be identified as item 88, to parallel elliptical rails 13 on the exterior surface 89 of the helmet 10. Each rail 13 has a profile designed to (1) avoid the accumulation of dirt on the rails and on the wheels, (2) make the wheels have a narrow contact on the rails 13.

Figure 3A:
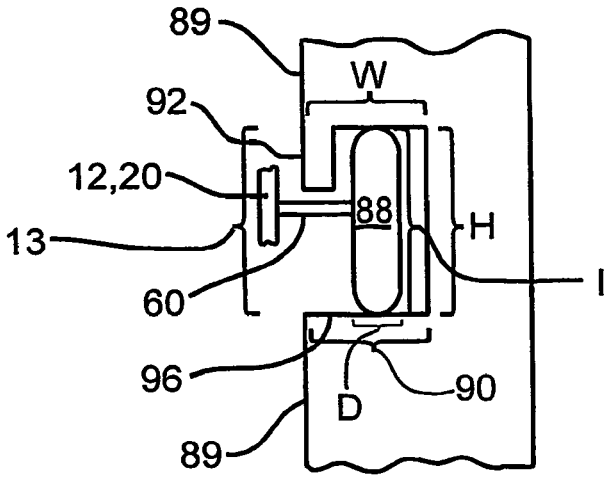
FIGS. 3*a–c* illustrate different embodiments of the wheel in the rail system.
Figure 3C:
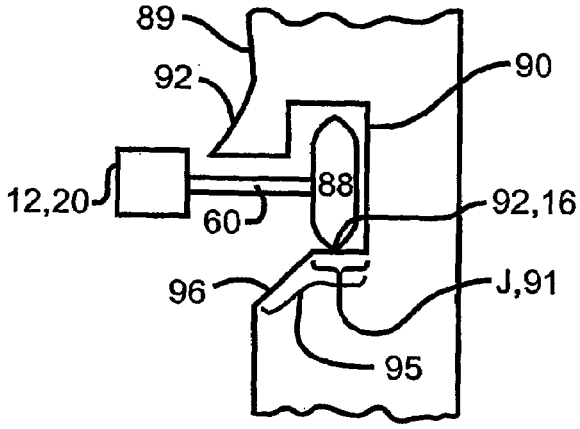
Figure 3B:
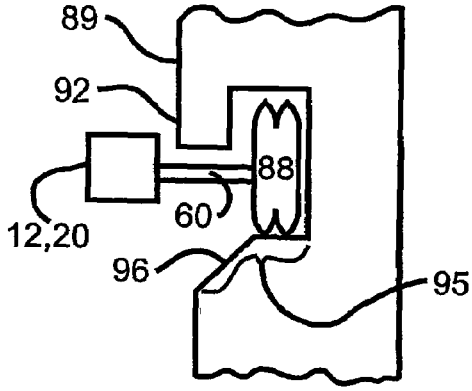

Turning to FIGS. 3*a*, 3*b*, and 3*c*, these figures illustrate cross-sectional views of a wheel 88 within a portion of the rail 13. The rail 13 is a part of the exterior surface of the helmet 10. The rail 13 has a recess area 90 that intrudes into the helmet 10. The recess area 90 has a width W and height H which are respectively greater than, or in at least one embodiment equal to, the width D and height I of the wheel 88 which allows the wheels 88 to rotate within the rail 13. In addition the recess area 90 has a contact surface 91 that has a width J that is greater than the width K of the contacting portion 92 of the wheel 88 to allow the wheel 88 to rotate within the rail 13.

In some instances, the widths W and D, and J and K, and the heights H and L can be the same to provide zero clearance. Such zero clearance is used when the wheels 88 are made of material, like elastomeric polymers, that (1) minimizes rattling when the visors 11, 110 are moved in relation to the helmet 10, and (2) allows the wheels 88 to overcome an occasional obstacle when the wheels rotate within the rails 13.

Figure 4A:
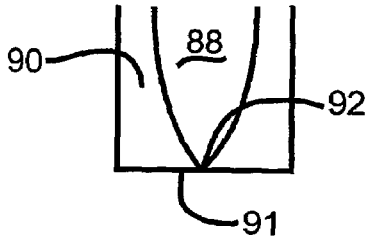
FIGS. 4*a–b* illustrate different wheel embodiments.
Figure 4B:
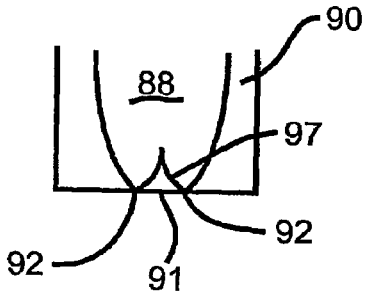

When the wheels 88 have the preferred or the non-preferred material, the wheels can overcome the occasional obstacle by the shape of the wheel's contacting surface 92. As shown in FIGS. 4*a* and 4*b*, the contacting surface 92 can be tapered into a single point as illustrated in FIG. 4*a*, or have at least one groove 97 which allows a plurality of point contacting surfaces as shown in FIG. 4*b*. In any case, the wheels are designed to overcome any and all obstacles that are on the rail 13.

Obstacles in the rail, however, are undesired. Hence, the inventors have designed rail profiles to prevent the build up of such obstacles. In one embodiment, the rail 13 has a lip 92 that extends over a predetermined portion of the recessed area 90, preferably the upper portion 93 of the recessed area 90. This lip 92 can be a straight surface in relation to the exterior surface 89, as shown in FIGS. 3*a* and 3*b*, or a flared surface in relation to the exterior surface 89, as shown in FIG. 3*b*. In any case, the lip 92 is designed to direct dirt and other undesired particles from accumulating in the rail 13.

The rail profile also has various designs for the bottom surface 95 of the recess area 90. The bottom surface 95 must have the contact surface 91 which is designed to allow the wheel 88 to rotate within the rail. Therefore, the contact surface 91 is preferably perpendicular, or close to being perpendicular, relative to the exterior surface 89, and also elliptical about the helmet. The remaining portion 96 that can be straight, as shown in FIG. 3*a*, or tapered away from the lip 92 as shown in FIGS. 3*b* and 3*c*. These designs are designed to direct dirt and other undesired particles from accumulating in the rail 13.

Figure 2A:
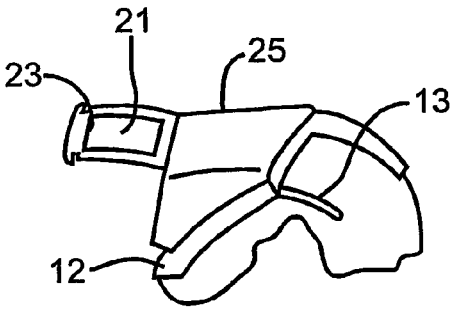
FIGS. 2*a, b, c, d, e*, and *f* illustrate various embodiments of the present invention.
Figure 2D:
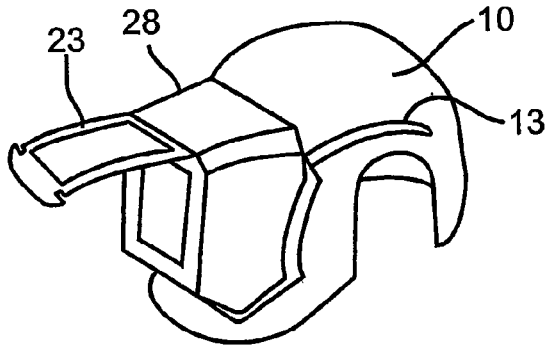
Figure 2E:
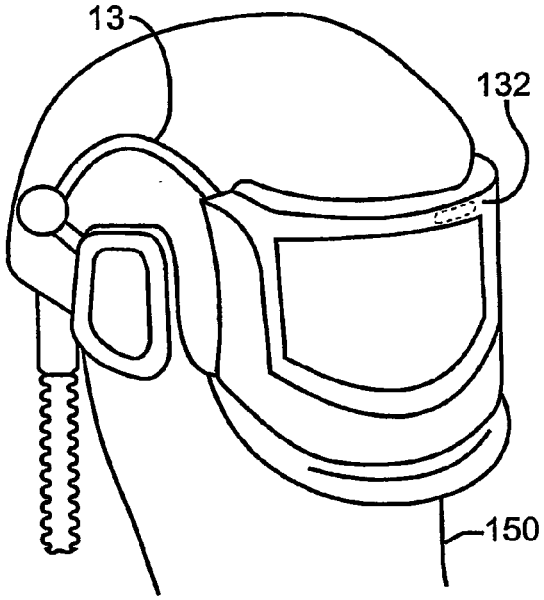
Figure 2F:
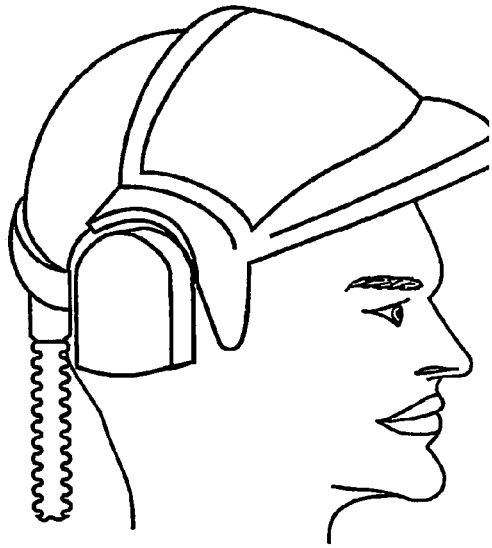

The wheels are in the rails because it allows the first and, the optional second, visors 11, 110 to rotate about the helmet without using a pivot point, which is used in the prior art. Without the pivot point, the helmet is better balanced resulting in increased user comfort. Additionally, the movement of the visors 11, 110 does not deviate as much from the helmet's natural center of gravity in relation to a pivot point visor, and the helmet can expose the user's ears for independent ear protection gear, independent hearing receivers and incorporated hearing receivers 30, which are illustrated in FIG. 2F.

Each wheel 88 rotates about an axis 60 that is securely attached to the frame member 12. The frame member 12 is made of a material that conforms to the desired industrial standards. In addition, the first visor 11 is securely attached to the frame member 12 in such a manner that it meets or exceeds the desired industrial standards for impact resistance, temperature resistance and the like.

The visor 12 material, like the attachment apparatus, has to meet or exceed the desired industrial standards for impact resistance, temperature resistance and the like. Such material includes and is not limited to polymer materials, such as those that include polyethylene.

Attached to the frame member 12 are a lower adaptor unit 15 and an upper adaptor unit 17. Each unit 15, 17 is designed to decrease dirt or other particulates from entering the area between the first visor assembly 11 and the user's face (hereinafter the "breathing zone") or the helmet. Each unit 15, 17 is interconnected to the frame member 12 and on the opposite side of the interconnection portion, each unit has a plurality of bristles 70 or a rubberized surface 70 that is designed to contact the exterior surface 89 when that portion of the unit 15, 17 is over the helmet 10. In addition, each unit 15, 17 through the bristles (rubber) 70 cleans the rails 13, and sometimes the exterior surface 89 of the helmet 10 when the unit 15, 17 passes thereon, which further ensures the rails 13 are particulate free. The bristles or rubberized surface 70 is also designed to form a releasable seal with a chin frame 152 (discussed in more detail below), which is designed to prevent undesired particulates to enter the breathing zone.

Figure 2C:
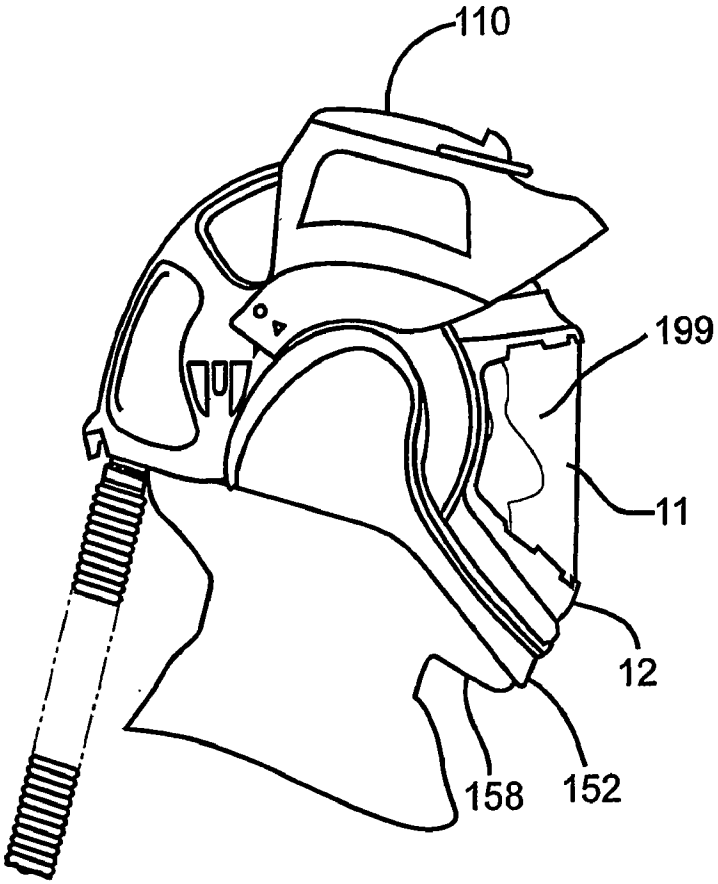
Figure 2B:
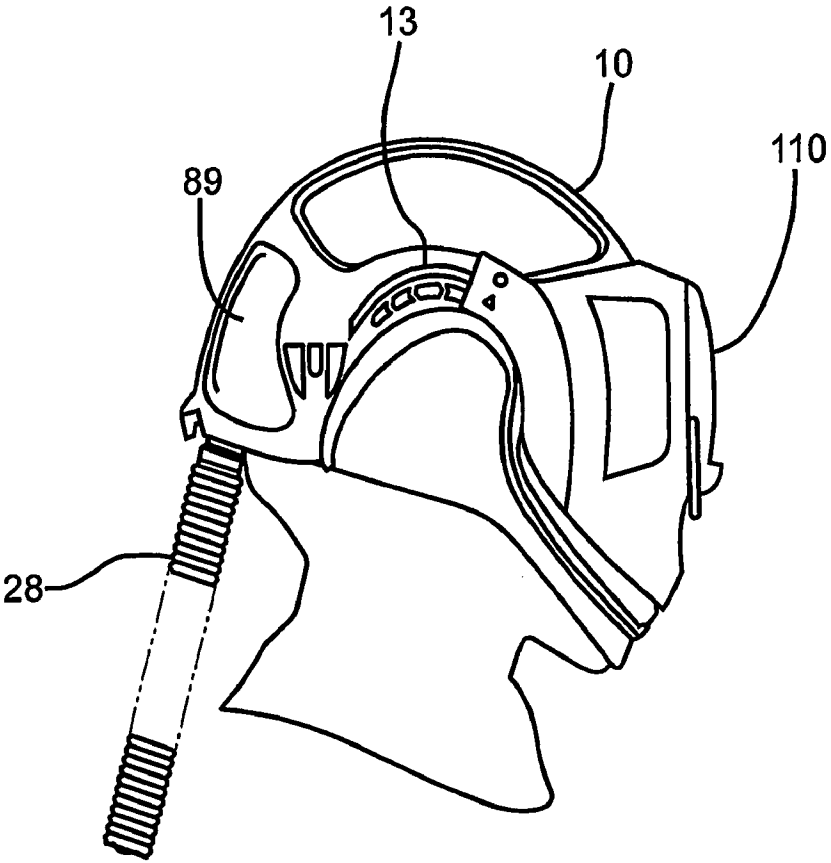

Alternatively, the second visor assembly 110 comprises a polymeric material 21 that is resistant to the environment (cold temperatures or heat resulting from fire), or resistant to particles, large or small, contacting it, or both, a frame 20 that contains the polymeric material 21. In one embodiment, the frame 20 is a single unit, as shown in FIG. 1, that contains the polymeric material 21. In another embodiment, the frame 20 is divided into two components, a flip-top-portion 23 and roller portion 25, as illustrated in FIGS. 2*a–d*. The flip-top portion 23 contains the polymeric material 21 and is able to be in an engage position, as shown in FIGS. 2*b* and *c*, or in the relax position, as shown in FIGS. 2*a* and *d*. In any embodiment, the frame 20 is able to move from an up position, as shown in FIG. 2*c*, to a down position as shown in FIGS. 2*a, b*, and *d*.

The frame 20 moves along the rails 13 by a set of wheels 88 having an axle 60 securely attached to the frame 20. This system operates in the same manner in which the wheels operate for the first visor assembly.

Figure 5:
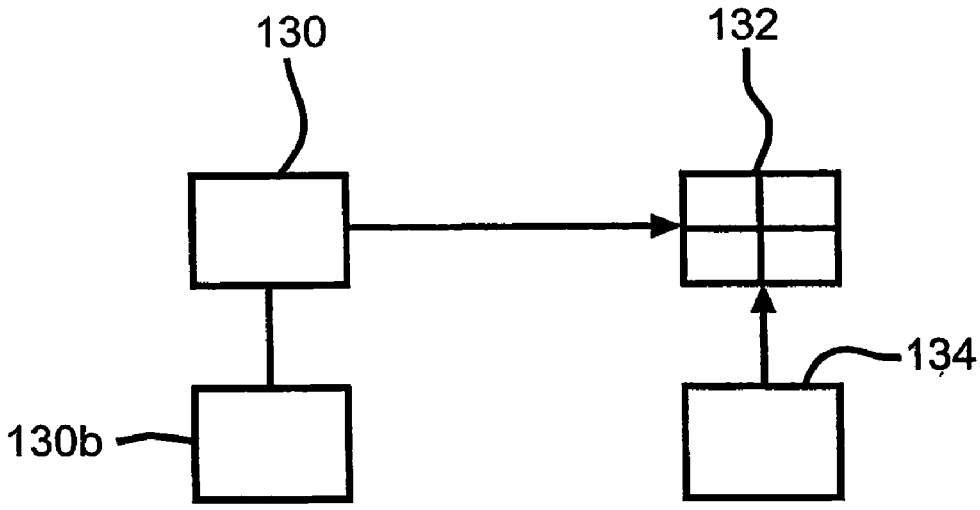
FIG. 5 illustrates an electrical schematic of the LED wire system.

Depending on the embodiment, the helmet 10, or a component attached to the user, has a conventional monitoring device 130 that measures the flow of the air entering the helmet 10 and being directed to the breathing zone 199 (the area between the user's face and the visor 11 as shown in FIG. 2*c*). When compressed air is used in lieu of powered air this alerts the user whether the air flow is sufficient for the user to continue using the respirator helmet. To assist the user know whether the air flow is sufficient for the user to continue using the respirator helmet, the helmet has at least a set of LEDs 132 to indicate the flow rate, as shown in FIG. 5. These LEDs can be seen by the user at the side or on the first visor assembly or the second visor assembly. These LEDs receive an electric signal from a generator positioned on or within the helmet, or as a component attached to the user.

The respiratory air supplied to the breathing zone enters the helmet 10 from an air tube 28. The air tube 28 receives its air from a conventional source, like an air supply unit 140 which can be, for example, a conventional cylinder bank, a conventional remote blower, a conventional remote compressor, a conventional power air purifying assembly including a filter, motor, filter cartridges and combinations thereof, may be interfaced with the air reservoir and the air flow control regulators of a conventional flow filter assembly, a conventional self contained breathing apparatus (which can be supplied by Scott Technologies, Inc. of Lancaster, N.Y. and Monroe, N.C.), or alternatively from ambient air. The helmet 10 has an aperture 32 and within that aperture, the helmet 10 receives the air tube 28 or the ambient air. The air tube 28, however, should have a particular interconnection unit to maximize the movement of the user. In particular, the preferred interconnection has the air hose 28 having a spherical male component 35 and the aperture 32 has a spherical female component 34. Preferably, each component 35, 34 are made of a material that provides minimal friction, like a polymer. Thereby, the hose 28 and the helmet 10 have greater and easier rotational independence from each other, compared to the prior art designs. Such independence avoids fatigue to the user.

The spherical female component 34 has a latch that rotates on a tangential orbit, identified as item 37. Thereby, the male component 35 can be easily removed.

The helmet 10 also has at least one channel 40, preferably a plurality, to direct the air from the removable spherical female component 34 to the breathing zone. The channel 40 is a polymeric, preferably polyethylene foam, conduit. The channel has one end connected to the air hose with a hose dock, and the other end is on a platform in the front part of the helmet 10. The channel 40 is longer that the space it is attached to, which provides tension to keep it in place without glue or other means of mounting, which could be used if desired. If the channel 40 is not permanently attached, then the channel 40 can be easily cleaned, which is desirable.

The channel 40 also acts as a shock absorbing material that provides additional protection to the user's skull (cranium area). The channel 40 also insulates the air and therefore can convert cold air to ambient air, if desired. By the same process, the channel 40 can also alter hot air or air with moisture accumulating within the helmet into ambient air by the air currents generated through the channel 40. The channel 40 is also a conduit for electronic circuitry and insulating such circuitry from damage within the helmet.

The device 10 can also have a small blower motor 130*b* with some circuitry and at least one wire leading to the LED, or group of LEDs, as shown in FIG. 5. The motor is mounted in the spherical female component (34) and basically acts as a small generator. The air flow turns the motor and generates current, which is used to build up a charge in a capacitor in the circuitry. Should the air flow decrease for some reason, the current from the motor will drop and the capacitor will be discharged over time through the circuitry to light the LED(s). The wires from the circuitry to the LED(s) are routed through, and protected by, the foam air channel. The LED(s) can also be interconnected to other devices 134, such as PASS units, self-contained breathing apparatuses, heat sensors, combinations thereof and the like.

Figure 6:
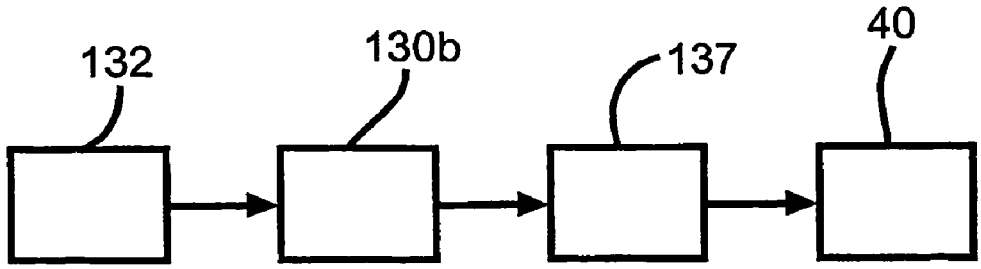
FIG. 6 illustrates an alternative embodiment of the present invention.

The blower motor can also draw in ambient air into the helmet. When ambient air is used, the ambient air is drawn into the aperture 32, through a filter system 137, and into the channel 40 to the breathing zone, as shown in FIG. 6. The filters used in this system are conventional filters that are known to those of ordinary skill in the art.

Figure 7C:
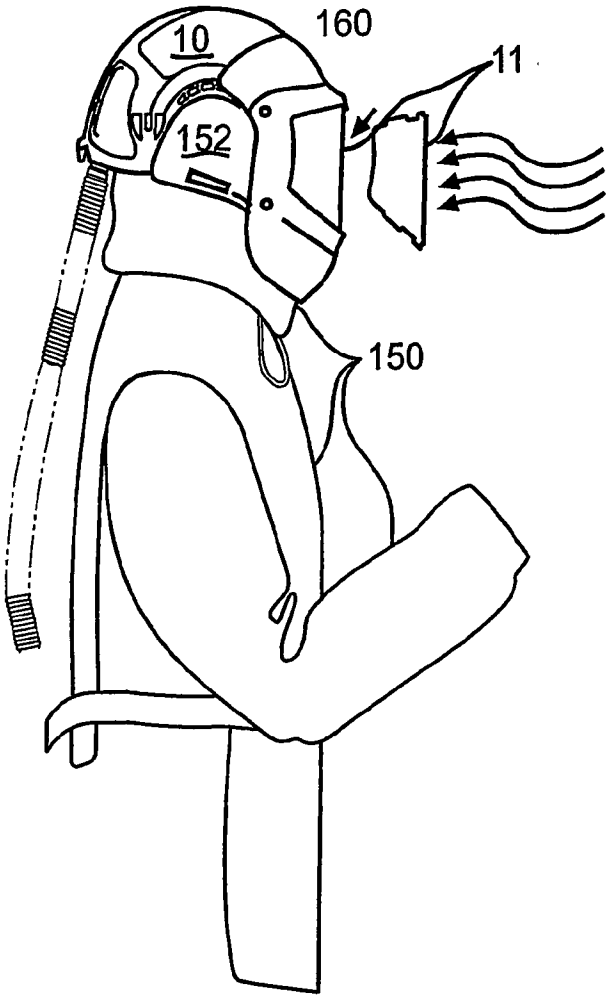

In addition, the respiratory helmet 10 can be fitted with a hood or shield 150 and a chin frame 152, as shown in FIGS. 7*a–f*. These hoods and shields can be any type of loose-fitting or tight fitting devices, examples of such hoods and shields are illustrated in FIGS. 7*a–f*. When the shields 150 are used, the helmet 10 calls for a chin frame 152. The chin frame 152 is a rigid to semi-rigid material that interconnects to the helmet 10. In particular, the chin frame 152 interconnects to the portion of the helmet 10 that is positioned above and behind the user's ears, as shown throughout FIG. 7. The interconnection between the chin frame 152 and the helmet 10 can be permanent or alternatively removable as shown in FIG. 7*f*. In either case, the means that the helmet 10 and the chin frame 152 interconnect together is through conventional techniques used in the industry. Examples of such techniques include and are not limited to sonic welds, rivets, indent fits, male and female snaps, nuts and bolts, hook and loop systems. Depending on the method to interconnect the chin frame 152 to the helmet 10, the chin frame 152 can have apertures 154, weld planes 156, or both, as shown in FIG. 8.

In addition, the chin frame 152 can have second apertures 158 positioned thereon. These apertures 158 can be air vents to allow the gaseous medium that enters the breathing zone to escape.

Attached to the lower portions of the chin frame 152 and the helmet 10 can be the hood/shield unit 150. The unit 150 can be removably attached with a a seal (preferred method), or alternatively permanently attached to the chin frame 152 and helmet 10. The unit 150 is gathered at the neck of the user. It may be loosely gathered at the neck to allow exhalation of gases between the neck gatherer and the neck or sealingly attached at the neck by means of rubber, draw strings, or elastic banding, or combinations thereof attached to the material. When sealing attached to the neck a exhalation or relief valve may be provided in the helmet 10 or in the air supply system of the helmet 10 in order to vent exhalation gases to the ambient environment. The unit 150 can be a neck protector, a neck and chest protector, a neck, chest and arm protector, as illustrated throughout FIG. 7. In any case, the unit 150 can be any conventional material that protects the user from the potential injury that the user is exposed to. For example, the unit 150 can be mesh, fire-retardant material, heat resistant material, cold-resistant material, chemical resistant material, biological resistant material, nuclear resistant material or combinations thereof.

The chin frame 152 and the visor frame 12 can have a means to sealingly contact each other. In particular propylene or silicone material can be used to provide this releasable sealing fit. Adapted to the bottom of the chin frame is the flexible barrier material 150.

These various embodiments illustrate the different uses and adaptations of the present helmet 10. The helmet can be used in the fire industry, the chemical industries, the welding industry and other related industry that may require respiratory helmets. In other words, the present helmet is adaptable for various applications and industries and can be easily converted for particular applications relatively easily and efficiently.

In addition, the visor 11 and the material 21 can be made of any type of material for a particular application. For example, the visor material 11, 21, can be made of transparent plastic or glass materials, or combinations thereof. In addition, the visor material 11, 21 can be embedded with mesh, coated with particular ultraviolet, infrared or natural light protectors, for example, gold, or combinations thereof. And as shown in FIG. 7*c*, the visor material 11, 21 can be removed and replaced with a desired visor material.

Figure 7B:
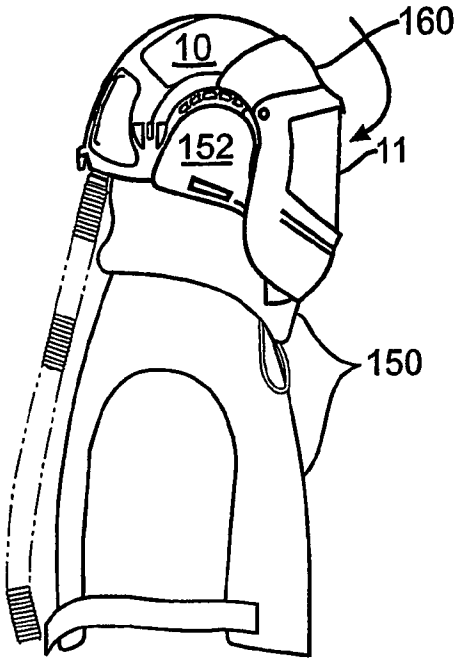
Figure 7A:
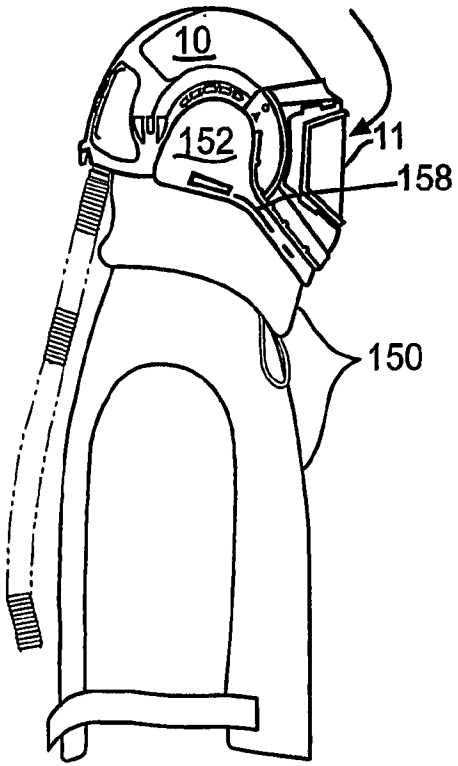
Figure 7E:
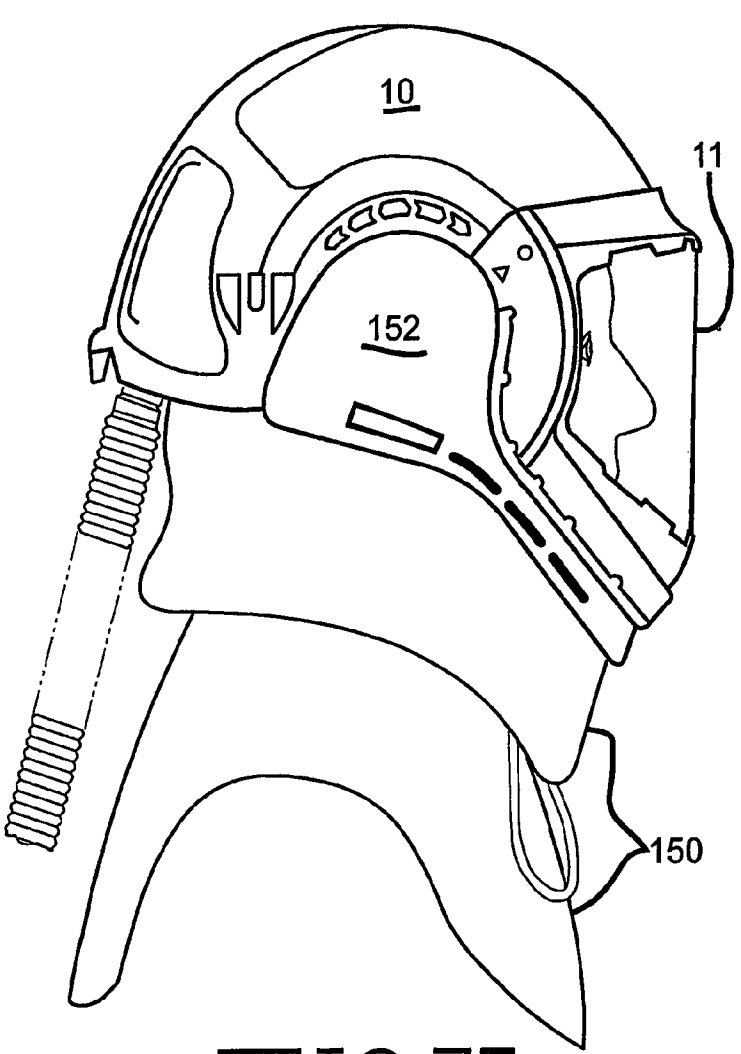
Figure 7D:
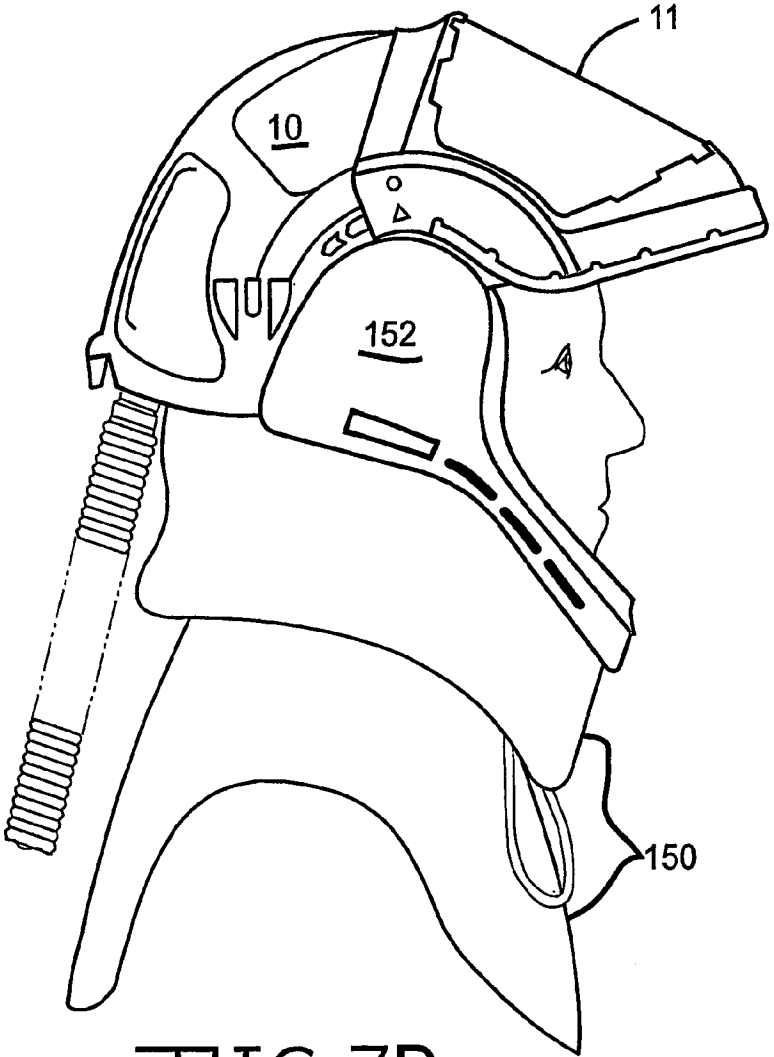
Figure 8:
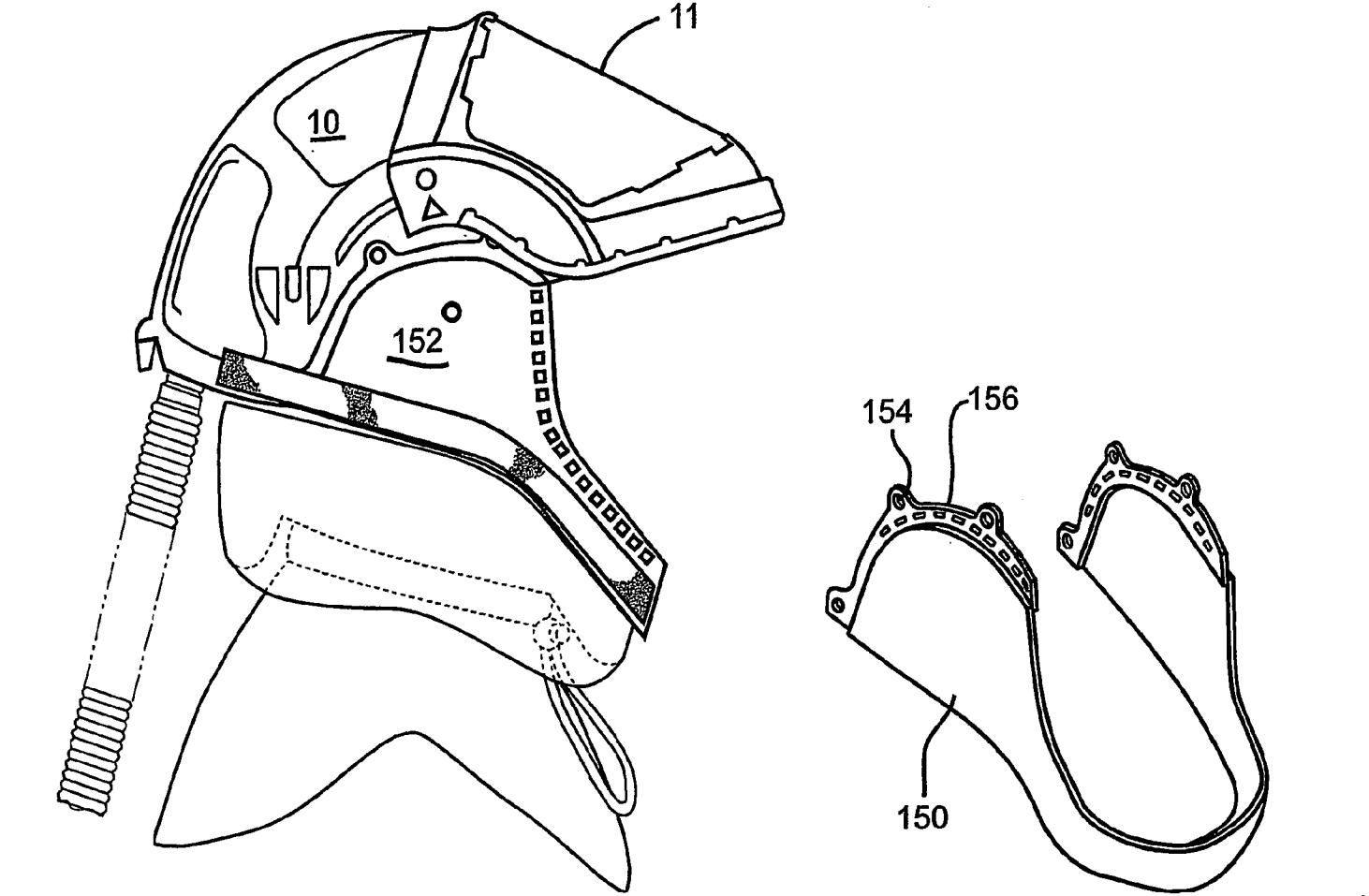
FIG. 8 illustrates a chin frame.

As shown in FIG. 7*b*, the helmet 10 can have a rubberized or metalized cover 160 thereon. The material is dependent on the application of which the helmet 10 is to be used.

While preferred embodiments of the invention have been illustrated and described it will be understood that modifications may be made within the competence of those skilled in the art without departing from the scope of the invention as defined in the appended claims.

We claim:

1. A respiratory helmet comprising:

a helmet configured to provide protection to a user's cranium area, the helmet including an exterior surface having parallel elliptical recess areas that intrude into the exterior surface of the helmet;

wheels rotatably received within the recess areas and, the wheels rotating along parallel elliptical paths relative to the helmet, each recess area being shaped to decrease accumulation of particulates in the recess area;

a visor joined to the wheels and configured to provide protection to the user's face area; the visor being moved relative to the helmet between positions remote from, and in front of, the user's face area, the visor defining a breathing zone between the visor and the front of the user's face area, the visor having a top side and a bottom side wherein the bottom side is positioned closer to the user's chin when the visor is positioned in front of the user's face; and an air intake system having an intake unit that receives a gaseous medium from one of a gaseous medium supply system and ambient air in the helmet, the intake unit directing the gaseous medium toward the breathing zone.

2. The respiratory helmet of claim 1 wherein the helmet does not cover the user's ears.

3. The respiratory helmet of claim 1 wherein the helmet covers the user's ears.

4. The respiratory helmet of claim 1 further comprising a conduit positioned between the intake unit and the breathing zone.

5. The respiratory helmet of claim 4 wherein the conduit is made of a material that decreases the chances of injury and shock to the user.

6. The respiratory helmet of claim 4 wherein the conduit is made of polyethylene foam.

7. The respiratory helmet of claim 1 wherein the exterior surface of the helmet includes lips formed therein, each of the lips covering an upper portion of the corresponding recessed area, the lips resisting particle build up in the recess areas.

8. The respiratory helmet of claim 7 wherein the lip is flared away from the helmet in a direction transverse to the elliptical path of the corresponding recess area.

9. The respiratory helmet of claim 7 wherein the lip is straight in relation to the exterior surface of the helmet.

10. The respiratory helmet of claim 1 wherein each of the wheels has at least one rotating contacting surface that is tapered to a single point that rotates along the recess area.

11. The respiratory helmet of claim 10 wherein the contacting surface of each wheel has at least one groove within the contacting surface.

12. The respiratory helmet of claim 1 wherein a set of LEDs are electrically connected to a third system that monitors the third system and positioned on the helmet in such a way that the user can view the LED's through the visor.

13. The respiratory helmet of claim 12 wherein the third system is selected from the group consisting of PASS units, self-contained breathing apparatuses, heat sensors, combinations thereof.

14. The respiratory helmet of claim 1 wherein a second visor is positioned over the visor.

15. The respiratory helmet of claim 14 wherein a set of LEDs are electrically connected to a third system that monitors the third system and positioned on the helmet in such a way that the user can view the LED's through the second visor.

16. The respiratory helmet of claim 15 wherein the third system is selected from the group consisting of PASS units, self-contained breathing apparatuses, heat sensors, combinations thereof.

17. The respiratory helmet of claim 14 wherein a set of LEDs are electrically connected to a unit that measures the quantity of the gaseous medium directed to the breathing zone, and positioned on the helmet in such a way that the user can view the LED's through the second visor.

18. The respiratory helmet of claim 1 wherein the gaseous medium supply system is a self-contained breathing apparatus.

19. The respiratory helmet of claim 1 wherein the gaseous medium supply system is ambient air.

20. The respiratory helmet of claim 1 having a fan within the air intake system.

21. The respiratory helmet of claim 1 wherein the helmet and the visor is designed to withstand impacts by objects, and variations of temperatures ranging from heat generated by fires to severe cold conditions.

22. The respiratory helmet of claim 1 wherein a set of LEDs are electrically connected to a unit that measures the quantity of the gaseous medium directed to the breathing zone, and positioned on the helmet in such a way that the user can view the LED's through the visor.

23. The respiratory helmet of claim 1 wherein the gaseous medium is air.

24. The respirator helmet of claim 1, wherein the recess areas each include a contact surface extending into the helmet substantially perpendicular to the exterior surface of the helmet, the wheels rolling along the corresponding contact surfaces.

25. The respirator helmet of claim 1, wherein the recess areas each include a contact surface extending into the helmet and include a ledge portion formed along the contact surface, the ledge portions extending between the contact surfaces and the exterior surface of the helmet, the ledge portions tapering away from the contact surfaces.

26. The respirator helmet of claim 1, wherein the exterior surface of the helmet includes lips formed therein and extending along the parallel elliptical paths, the lips covering upper portions of the corresponding recess areas, the lips having a flared surface flared outward away from the exterior surface of the helmet in a direction transverse to the parallel elliptical paths.

27. The respiratory helmet comprising a helmet designed to provide protection to a user's cranium area;

a visor designed to provide protection to the user's face area; the visor can be positioned on the helmet, in front of the user's face areas, and any position in between; the area between the visor, when the visor is positioned in front of the user's face area, and the face area is the breathing zone; the visor has at least two wheels; the visor has a top side and a bottom side wherein the bottom side is positioned closer to the user's chin when the visor is positioned in front of the user's face;

an air intake system having an intake unit that receives a gaseous medium from a gaseous medium supply system or the ambient air into the helmet, and the intake unit directs the gaseous medium toward the breathing zone;

a rail system on the helmet that allows the visor to move, each rail receives at least one wheel of the visor; and an adaptor unit attached to the bottom side of the visor to decrease the accumulation of particulates into the breathing zone when the visor is positioned in front of the user's face, and onto the helmet when the visor is positioned entirely on the helmet.

28. The respiratory system of claim 27, wherein the rail system includes parallel elliptical recess areas that intrude into an exterior surface of the helmet.

29. The respiratory helmet of claim 28, wherein the exterior surface of the helmet includes lips formed therein, each of the lips covering an upper portion of the corresponding recess area, the lips resisting particle build up in the recess areas.

30. The respirator helmet of claim 28, wherein the recess areas each include a contact surface extending into the helmet substantially perpendicular to the exterior surface, the wheels rolling along the corresponding contact surfaces.

31. The respirator helmet of claim 27, wherein the rail system includes parallel elliptical rails, in which the wheels rotate to move the visor along an elliptical motion.

32. The respiratory helmet comprising:

a helmet designed to provide protection to a user's cranium area;

a visor designed to provide protection to the user's face area; the visor can be positioned on the helmet, in front of the user's face area, the area between the visor, when the visor is positioned in front of the user's face area, and the face area is the breathing zone; the visor has at least two wheels; the visor has a top side and a bottom side wherein the bottom side is positioned closer to the user's chin when the visor is positioned in front of the user's face;

an air intake system having an intake unit that receives a gaseous medium from a gaseous medium supply system or the ambient air into the helmet, and the intake unit directs the gaseous medium toward the breathing zone;

a rail system on the helmet that allows the visor to move each rail receives at least one wheel of the visor; and a second visor positioned over the visor wherein the second visor has at least two wheels and at least one wheel from the second visor is positioned on a corresponding rail of the rail system so the second visor can be moved.

33. The respiratory system of claim 32, wherein the rail system includes parallel elliptical recess areas that intrude into an exterior surface of to helmet.

34. The respiratory helmet of claim 33, wherein the exterior surface of the helmet includes lips formed therein, each of the lips covering an upper portion of the corresponding recess area, the lips resisting particle build up in the recess areas.

35. The respirator helmet of claim 33, wherein the recess areas each include a contact surface extending into the helmet substantially perpendicular to the exterior surface, the wheels rolling along the corresponding contact surfaces.

36. The respirator helmet of claim 32, wherein the rail system includes parallel elliptical rails, in which the wheels rotate to move the visor along an elliptical motion.

37. A respiratory helmet comprising:

a helmet designed to provide protection to a user's cranium area;

a visor designed to provide protection to the user's face area; the visor can be positioned on the helmet, in front of the user's face area, and any position in between; the area between the visor, when the visor is positioned in front of the user's face area, and the face area is the breathing zone; the visor has a top side and a bottom side wherein the bottom side is positioned closer to the user's chin when the visor is positioned in front of the user's face area;

an air intake system having an intake unit that receives a gaseous medium from a gaseous medium supply system or the ambient air into the helmet, and the intake unit directs the gaseous medium toward the breathing zone;

a chin frame that extends from the helmet and is designed to protect the user's chin, and when the visor positioned in front of the user's face area, the bottom side forms a releasable sealingly engagement with the chin frame, and a flexible particulate barrier material that prevents the contamination of the breathing area from undesired particulates, and is attached to the helmet and the chin frame and covers at least a portion of the user's neck.

38. The helmet of claim 37 wherein the particulate bather material is removable.

39. The helmet of claim 37 wherein the chin frame is removable.

40. The respiratory system of claim 37, wherein the helmet includes parallel elliptical recess areas that intrude into an exterior surface of the helmet, the visor being moved along the recess areas to be positioned in front of, and remote from, the user's face area.

41. The respiratory helmet of claim 40, wherein the exterior surface of the helmet includes lips formed therein, each of the lips covering an upper portion of the corresponding recess area, the lips resisting particle build up in the recess areas.

42. The respirator helmet of claim 40, wherein the recess areas each include a contact surface extending into the helmet substantially perpendicular to the exterior surface, the wheels rolling along the corresponding contact surfaces.

43. A respiratory helmet comprising:

the helmet including rails provided on an exterior of the helmet;

wheels received in the rails and traveling along paths relative to the helmet;

a helmet configured to provide protection to a user's cranium area;

a visor joined to the wheels and configured to provide protection to the user's face area; the visor being rotated relative to the helmet between positions remote from, and in front of, the user's face area, the visor defining a breathing zone between the visor and the front of the user's face area, the visor having a top side and a bottom side wherein the bottom side is positioned closer to the user's chin when the visor is positioned in front of the user's face;

an air intake system having an intake unit that receives a gaseous medium from one of a gaseous medium supply system and ambient air in the helmet, the intake unit directing the gaseous medium toward the breathing zone; and a cleaning unit provided on the top side of the visor to clean the rails when the helmet is moved between the positions remote from, and in front of, the user's face area.

44. A respiratory helmet comprising:

a helmet configured to provide protection to a user's cranium area, the helmet including parallel elliptical rails provided on an exterior of the helmet;

wheels received in the rails and traveling along parallel elliptical paths relative to the helmet, each rail being shaped to decrease accumulation of particulates on the rail;

a visor joined to the wheels and configured to provide protection to the user's face area, the visor being rotated relative to the helmet between positions remote from, and in front of, the user's face area, the visor defining a breathing zone between the visor and the front of the user's face area, the visor having a top side and a bottom side wherein the bottom side is positioned closer to the user's chin when the visor is positioned in front of the user's face;

an air intake system having an intake unit that receives a gaseous medium from one of a gaseous medium supply system and ambient air in the helmet, the intake unit directing the gaseous medium toward the breathing zone; and a chin frame extending from the helmet and configured to protect the user's chin, wherein, when the visor is positioned in front of the user's face area, the bottom side of the visor forms a releasable sealingly engagement with the chin frame.

* * * * *